US009895587B2

(12) United States Patent
Liang

(10) Patent No.: US 9,895,587 B2
(45) Date of Patent: Feb. 20, 2018

(54) COMPOSITE GOLF BALL-HITTING MECHANISM

(71) Applicant: Zhe-Ming Liang, Taipei (TW)

(72) Inventor: Zhe-Ming Liang, Taipei (TW)

( * ) Notice: Subject to any disclaimer, the term of this patent is extended or adjusted under 35 U.S.C. 154(b) by 0 days.

(21) Appl. No.: 14/676,834

(22) Filed: Apr. 2, 2015

(65) Prior Publication Data

US 2015/0283437 A1 Oct. 8, 2015

(30) Foreign Application Priority Data

Apr. 3, 2014 (TW) ..... 103205781 U

(51) Int. Cl.

| | |
|---|---|
| ***A63B 57/00*** | (2015.01) |
| ***A63B 69/36*** | (2006.01) |
| ***A63B 57/20*** | (2015.01) |
| ***A63B 57/10*** | (2015.01) |

(52) U.S. Cl.

CPC ..... *A63B 57/0018* (2013.01); *A63B 57/0031* (2013.01); *A63B 57/10* (2015.10); *A63B 57/203* (2015.10); *A63B 69/3661* (2013.01)

(58) Field of Classification Search

CPC ..... A63B 57/15; A63B 57/0018; A63B 57/10; A63B 57/203; A63B 57/0031; A63B 69/3661

USPC ..... 473/391

See application file for complete search history.

(56) References Cited

U.S. PATENT DOCUMENTS

| | | | | | |
|---|---|---|---|---|---|
| 1,552,294 | A * | 9/1925 | Gledhill | A63B 57/10 | 473/390 |
| 1,856,259 | A * | 5/1932 | Lyons | A63B 57/10 | 473/278 |
| 3,112,111 | A * | 11/1963 | Bennett | A63B 57/10 | 473/391 |
| D279,121 | S * | 6/1985 | Wampler | D21/717 | |
| 4,962,924 | A * | 10/1990 | James | A63B 69/0075 | 473/417 |
| 6,482,111 | B1 * | 11/2002 | Jofferion | A63B 57/10 | 473/386 |
| 2005/0143196 | A1 * | 6/2005 | Tsai | A63B 69/0002 | 473/417 |
| 2006/0019764 | A1 * | 1/2006 | Gegelys | A63B 69/3641 | 473/265 |

* cited by examiner

*Primary Examiner* — Joshua T Kennedy

(57) ABSTRACT

A composite golf ball-hitting mechanism includes a base, a plurality of golf tees, and a cover layer. A first track is disposed on the base to not only hold the golf tees of different sizes but also guide selected ones of the golf tees to a hitting position. Golf balls are positioned at the golf tees and hit, respectively.

4 Claims, 11 Drawing Sheets

COMPOSITE GOLF BALL-HITTING MECHANISM

BACKGROUND OF THE INVENTION

1. Technical Field

The present invention relates to composite golf ball-hitting mechanisms, and more particularly, to a composite golf ball-hitting mechanism for providing golf tees which come in different sizes available to golfers for selection.

2. Description of Related Art

One of the popular sports nowadays is golf. In addition to golf clubs with various functions, golfers need golf tees each for holding a golf ball for the first stroke of each hole. Golf tees of different heights are required to propel the golf balls different distances. Referring to FIG. 1 and FIG. 2, a conventional golf tee 1 essentially comprises a shaft portion 11 with two ends, an apex 12 disposed at one of the two ends, and a dish 13 disposed at the other one of the two ends. After the apex 12 has been inserted into the lawn of a golf course, a golf ball 2 is put on the dish 13 and then hit. However, the size of the golf tee 1 is the key to the reach of the golf ball 2. For this reason, not only must a golfer carry the golf tees 1 of different sizes simultaneously, but the golfer must also insert the golf tee 1 into the lawn of the golf course before hitting the golf ball; as a result, not only does the golf tee 1 lack ease of use, but the golfer is likely to hit and fling the golf tee 1 when hitting the golf ball, and thus eventually the golfer has to gather the golf tee 1 located afield. Last but not least, the golf tee 1 has the apex 12; hence, not only does the flinging golf tee 1 pose a threat to sports safety, but the storage of the golf tee 1 is also difficult.

BRIEF SUMMARY OF THE INVENTION

The present invention provides a composite golf ball-hitting mechanism characterized in that: after a golf tee is selected, the selected golf tee can be moved to a hitting track under the guide of a first track, so that a golf ball is positioned on the selected golf tee and hit.

The present invention provides a composite golf ball-hitting mechanism, comprising:

a base having thereon a first track;

a plurality of golf tees disposed in the first track of the base;

a cover layer disposed on the base and having a second track, with the second track corresponding in position to and disposed above the first track, wherein the golf tees penetrate the second track and slide along the first track and the second track.

The first track of the base comprises a plurality of standby tracks, a hitting track, and a slot.

The golf tees are disposed at the standby tracks of the first track, and selected ones of the golf tees are moved to the hitting track.

The golf tees each have a shaft portion, a ball-hold surface, and a bottom portion.

The golf tees are of different heights.

The present invention has advantages described below.

The present invention provides a composite golf ball-hitting mechanism which essentially comprises a base, golf tees, and a cover layer. The golf tees are disposed at the standby tracks of the base. Selected ones of the golf tees are guided by the first track to the hitting track, and then golf balls are positioned at selected ones of the golf tees and hit.

According to the present invention, a slot is disposed at one end of the first track of the base. The golf tees are loaded to and unloaded from the base through the slot. Switching to a golf tee of another size can be achieved through the slot.

DETAILED DESCRIPTION OF THE INVENTION

Figure 1:
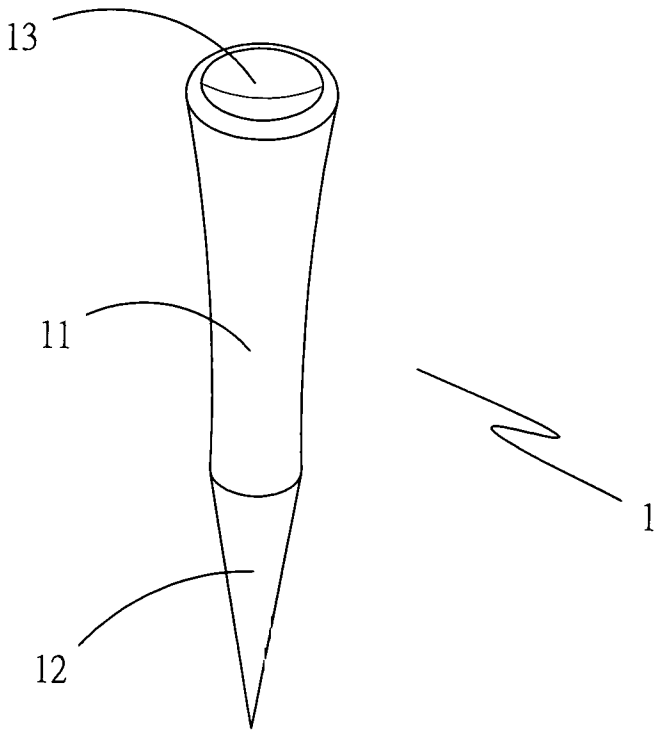
FIG.1 (Prior Art)
FIG. 1 (prior art) is a perspective view of the prior art.
Figure 2:
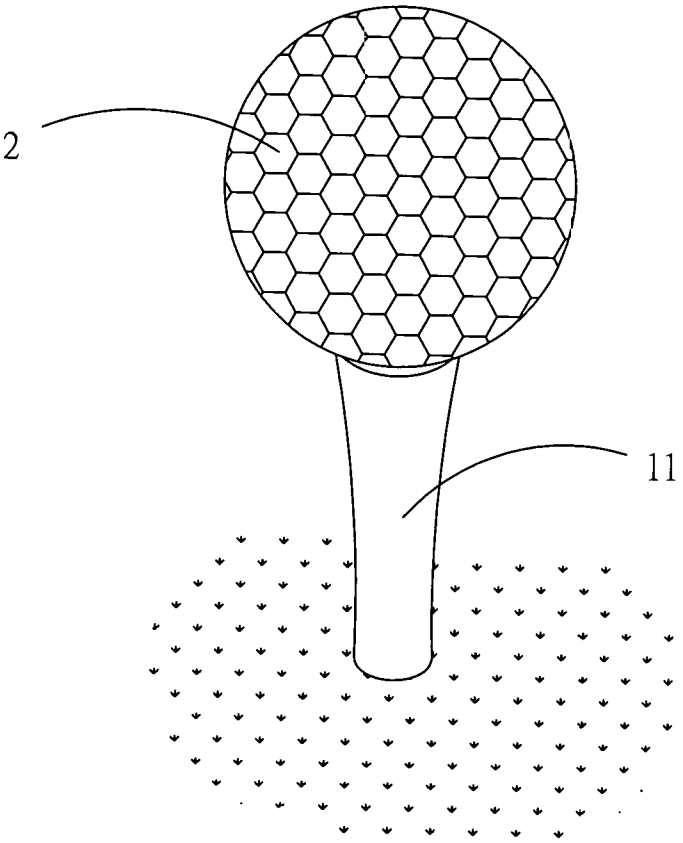
FIG.2 (Prior Art)
FIG. 2 (prior art) is a schematic view of an embodiment of the prior art.
Figure 3:
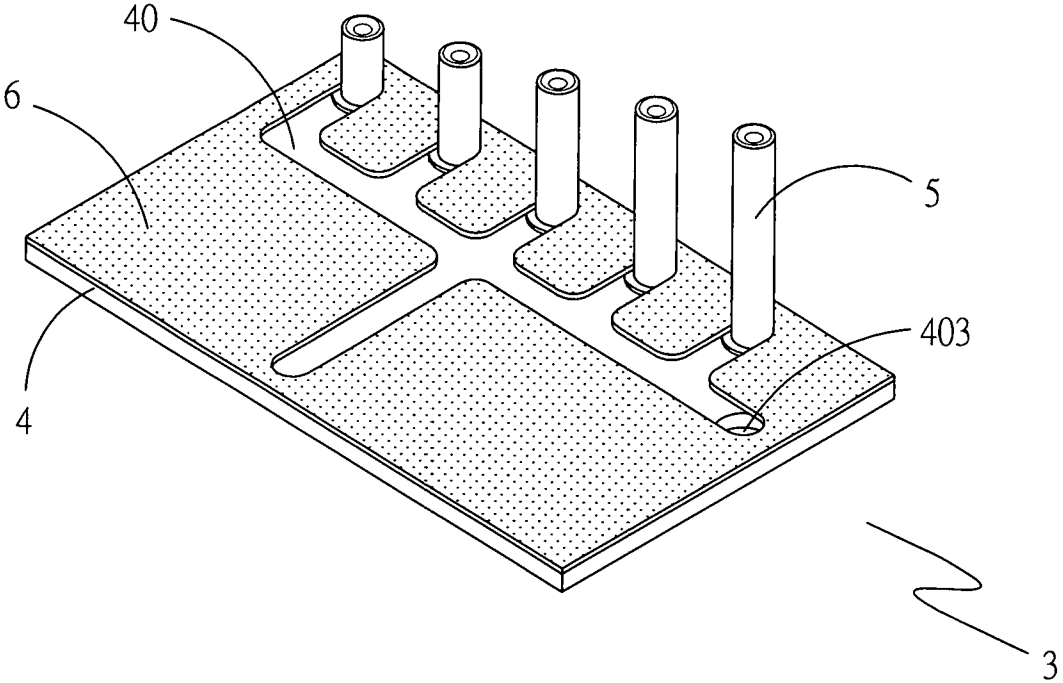
FIG. 3 is a perspective view of the present invention.
Figure 4:
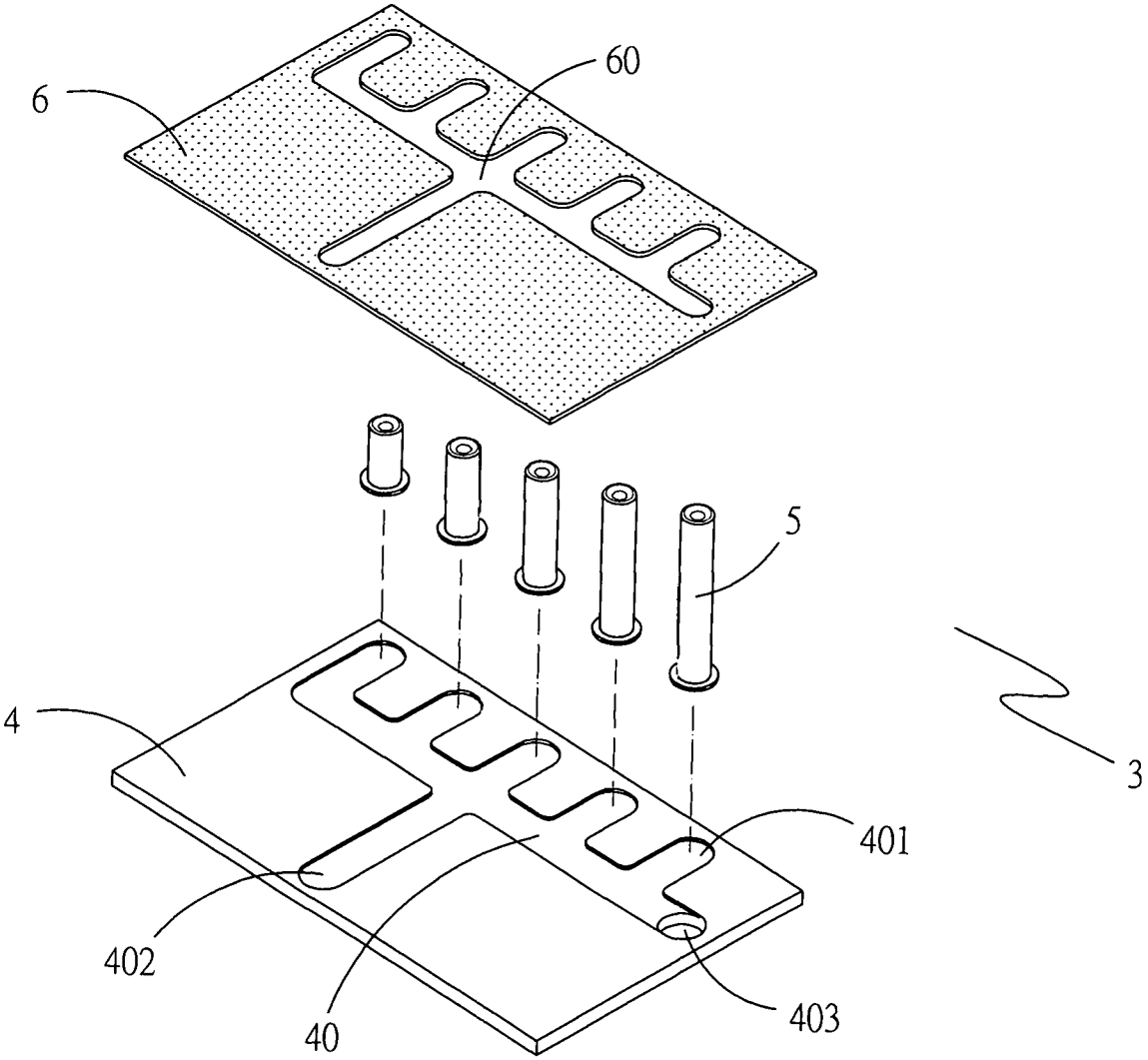
FIG. 4 is an exploded view of the present invention.
Figure 5:
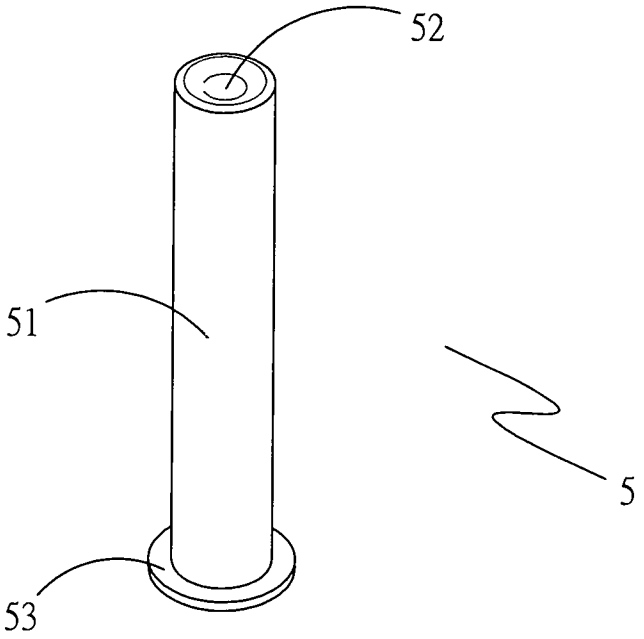
FIG. 5 is a partial schematic view of the present invention.
Figure 6:
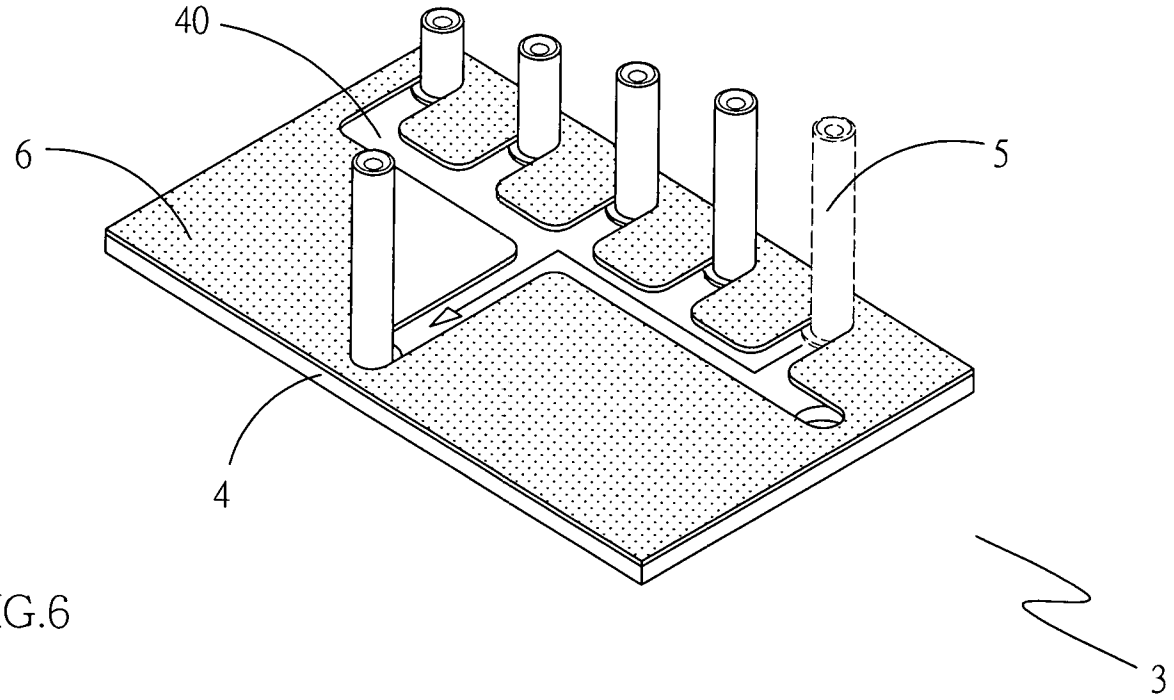
FIG. 6 is a schematic view of a golf tee in motion according to the present invention.
Figure 7:
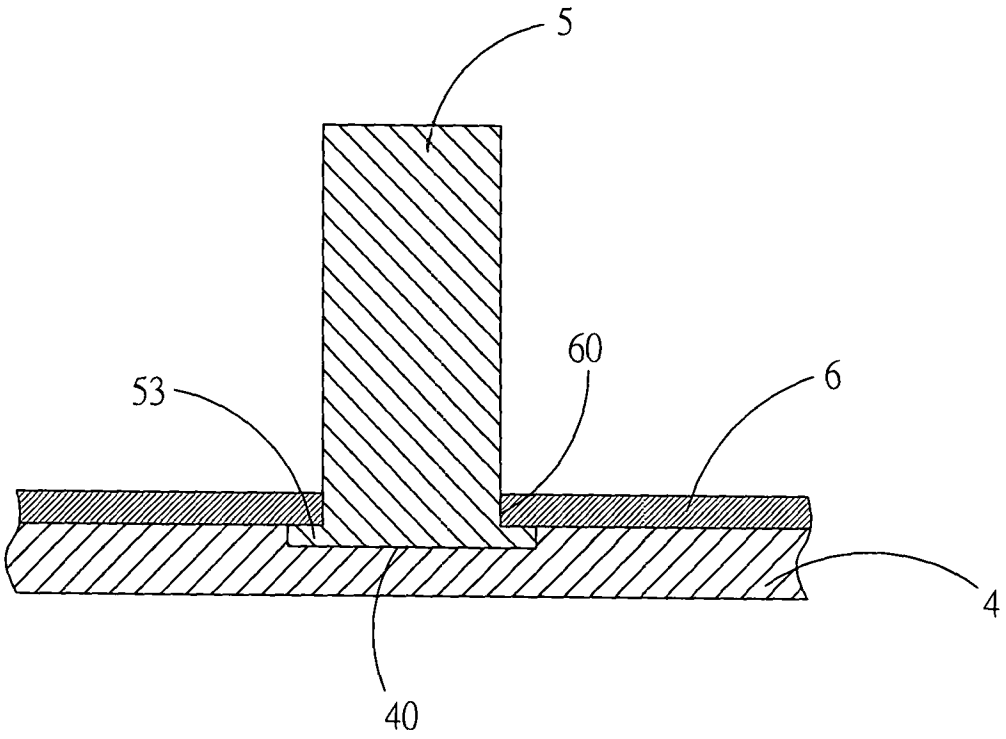
FIG. 7 is a partial cross-sectional view of the present invention.
Figure 8:
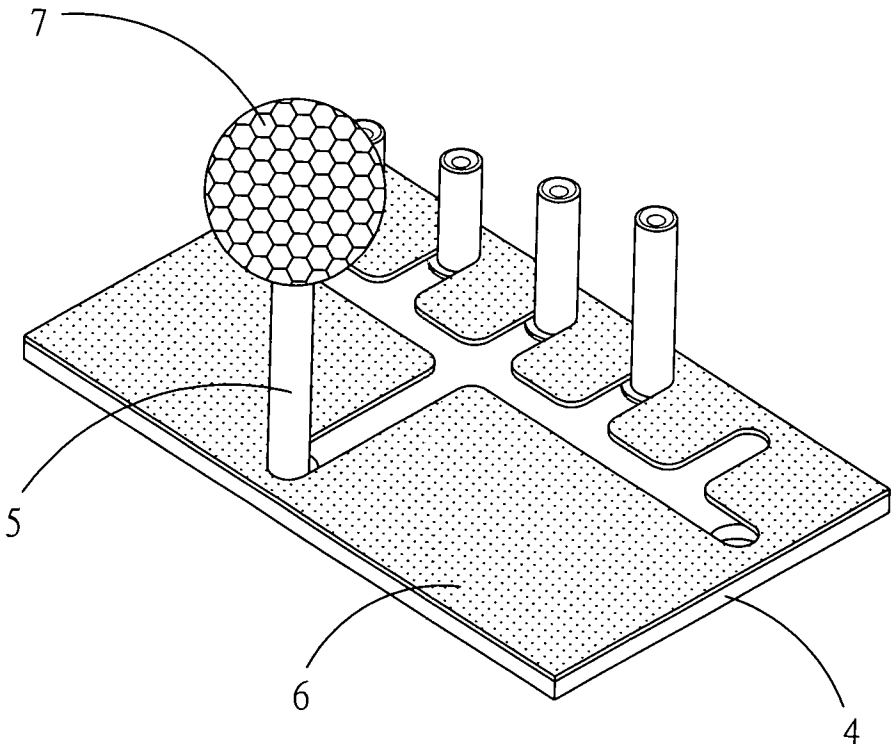
FIG. 8 is a schematic view of the golf tee moved to a hitting track according to the present invention.
Figure 9:
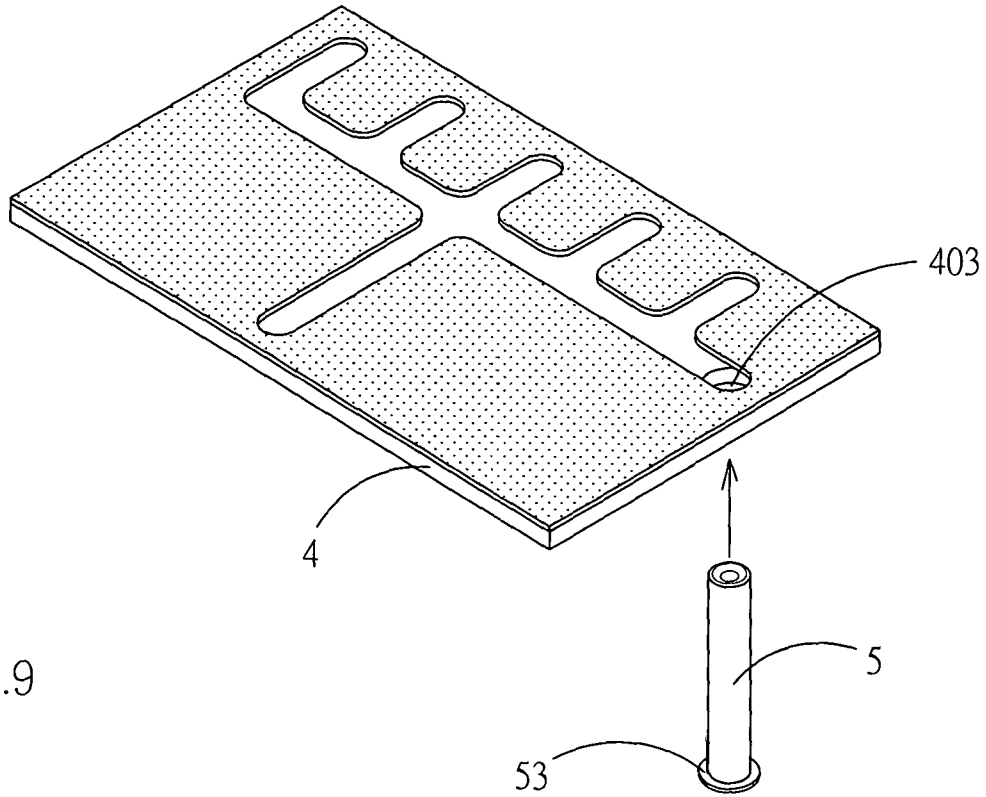
FIG. 9 is a schematic view of the golf tee and a slot of a base separated from the golf tee according to the present invention.
Figure 10:
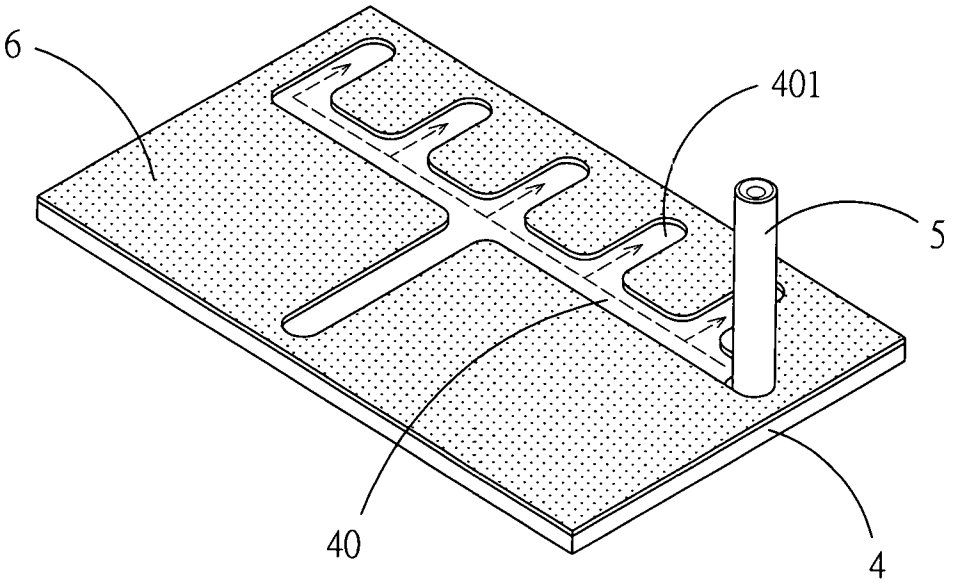
FIG. 10 is a schematic view of paths of movement of the golf tee according to the present invention.
Figure 11:
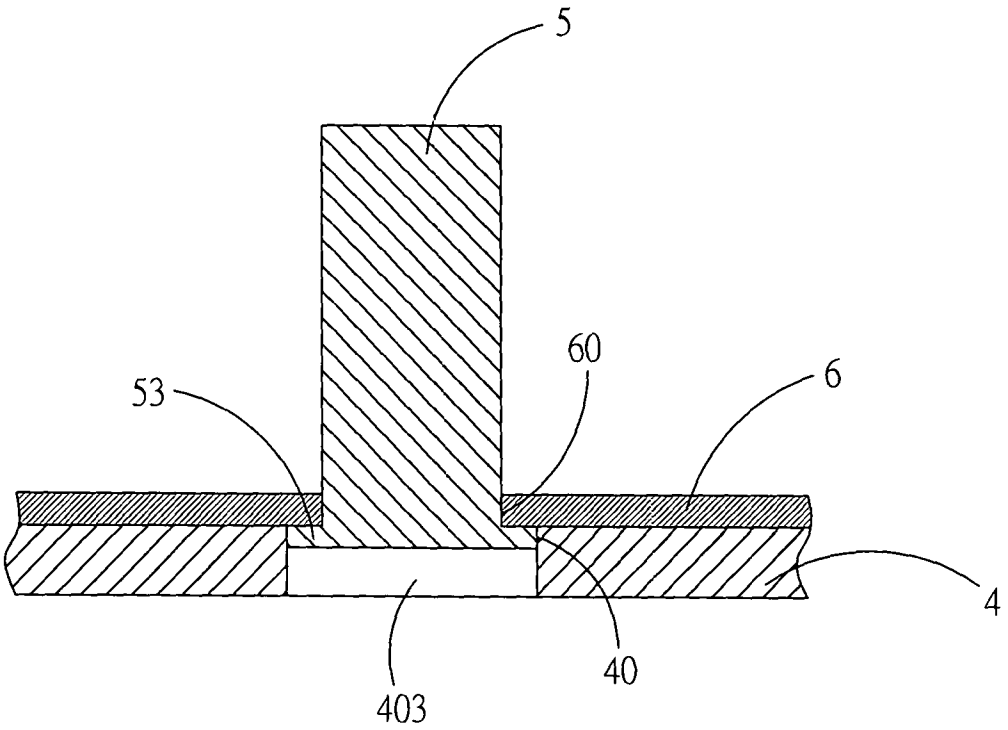
FIG. 11 is a cross-sectional view of the golf tee inserted into the slot according to the present invention.

Referring to FIG. 3, FIG. 4, FIGS. 5, 6, 8, 9, 10, and FIGS. 7, 11, there are shown a perspective view, an exploded view, schematic views, and cross-sectional views according to a preferred embodiment of the present invention, respectively. As shown in the diagrams, a golf ball-hitting mechanism 3 comprises a base 4, plurality of golf tees 5, and a cover layer 6.

The base 4 has thereon a first track 40. The first track 40 comprises a plurality of standby tracks 401, a hitting track 402 and a slot 403.

The golf tees 5 are disposed in the first track 40 of the base 4. The golf tees 5 each have a shaft portion 51, a ball-hold surface 52 and a bottom portion 53. The golf tees 5 are of different heights.

The cover layer 6 has a second track 60 and is disposed on the base 4. The second track 60 of the cover layer 6 corresponds in position to the first track 40 of the base 4.

Before they are in use, the golf tees 5 are disposed in the standby tracks 401 of the first track 40. After a golfer has selected one of the golf tees 5 according to an intended size and height, the golfer moves the selected golf tee 5 to a hitting track 402 under the guide of the first track 40. Then, the golfer puts a golf ball 7 on the ball-hold surface 52 of the selected golf tee 5 before hitting the golf ball 7. To switch to another golf tee 5 of another size and height, the golfer moves the previously selected golf tee 5 to one of the standby tracks 401 and then moves the golf tee 5 of another size and height to the hitting track 402.

The cover layer 6 disposed on the base 4 is characterized in that: the second track 60 of the cover layer 6 corresponds in position to the first track 40 of the base 4; the second track 60 has the same shape and contour as the first track 40; the second track 60 has a size and width slightly less than the first track 40 (shown in FIG. 7); the width of the second track 60 is substantially equal to the diameter of the shaft portion 51 of the golf tee 5, whereas the width of the first track 40 is substantially equal to the diameter of the bottom portion 53 of the golf tee 5, so that the bottom portion 53 of the golf tee 5 is confined to the first track 40 of the base 4. Since the bottom portion 53 of the golf tee 5 is put under restraint by the cover layer 6, the golf tee 5 cannot be flung off when the golf ball 7 is hit.

The slot 403 is disposed at one end of the first track 40. The golf tees 5 are loaded to and unloaded from the slot 403. A change of the golf tees 5 (shown in FIG. 9, FIG. 10, and FIG. 11) of different sizes and heights entails mounting the golf tees 5 on the slot 403 and then moving the mounted golf tees 5 to the standby tracks 401.

In conclusion, unlike the prior art which requires golfers to carry golf tees of different sizes inconveniently, the present invention provides the golf ball-hitting mechanism 3 which comprises the first track 40 for holding the golf tees 5 of different sizes simultaneously to not only allow golfers to select and mount the golf tees 5 of different sizes quickly so as to propel golf balls different distances but also prevent the golf tees 5 from being flung off immediately after a stroke and thus dispense with the hassles of gathering the golf tees 5 located afield. The golf ball-hitting mechanism 3 not only provides the golf tees 5 simultaneously but also makes it easy to carry and store the golf tees 5.

What is claimed is:

1. A composite golf ball-hitting mechanism, comprising:

a base having thereon a continuous first track comprising: a plurality of standby tracks, a hitting track, and a slot connecting the standby tracks with the hitting track;

a plurality of golf tees disposed in the first track of the base; and a cover layer disposed on the base and having a second track, with the second track corresponding in position to and disposed above the first track, wherein the plurality of golf tees penetrate the second track and are configured to selectively slide along the first track and the second track from the standby tracks to the hitting track via the slot.

2. The composite golf ball-hitting mechanism of claim 1, characterized in that the plurality of golf tees are disposed at the standby tracks of the first track, and a selected one of the plurality of golf tees is moved to the hitting track.

3. The composite golf ball-hitting mechanism of claim 1, characterized in that the plurality of golf tees each has a shaft portion, a ball-hold surface, and a bottom portion.

4. The composite golf ball-hitting mechanism of claim 1, characterized in that the plurality of golf tees are of different heights.

* * * * *